US008128081B2

(12) United States Patent
Hamano et al.

(10) Patent No.: US 8,128,081 B2
(45) Date of Patent: Mar. 6, 2012

(54) DOCUMENT FEEDING APPARATUS

(75) Inventors: Shigemichi Hamano, Abiko (JP); Nobuo Sekiguchi, Moriya (JP); Akiko Kanno, Kashiwa (JP); Kenji Morita, Toride (JP); Satoshi Seki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 12/635,057

(22) Filed: Dec. 10, 2009

(65) Prior Publication Data

US 2010/0148420 A1 Jun. 17, 2010

(30) Foreign Application Priority Data

Dec. 17, 2008 (JP) ..... 2008-321630

(51) Int. Cl.
*B65H 85/00* (2006.01)

(52) U.S. Cl. ..... 271/3.14; 271/117

(58) Field of Classification Search ..... 271/3.14, 271/3.15, 126, 127, 117
See application file for complete search history.

(56) References Cited

U.S. PATENT DOCUMENTS 6,091,927 A 7/2000 Hattori

FOREIGN PATENT DOCUMENTS

JP 09-166831 A 6/1997
JP 2004-166052 A 6/2004
JP 2004166052 A * 6/2004

* cited by examiner

*Primary Examiner* — Michael McCullough
(74) *Attorney, Agent, or Firm* — Canon USA Inc IP Division

(57) ABSTRACT

A document feeding apparatus includes a document tray configured to receive a document placed thereon and to move up and down, a start key configured to issue a command to start a process accompanied by a document feeding of the feeding unit, and an operation key configured to be used to set a condition for the process. The document feeding apparatus is operable in a first mode or second mode, wherein the first mode the document tray is raised in response to an operation of the start key and in the second mode, the document tray is raised in response to an operation of the operation key.

6 Claims, 11 Drawing Sheets

DOCUMENT FEEDING APPARATUS

BACKGROUND OF THE INVENTION

1. Field of the Invention

The present invention relates to a document feeding apparatus having a document tray movable up and down.

2. Description of the Related Art

In recent years, an image reading apparatus has been widely used that is configured to convert image information of a document into digital data and outputs the resultant digital data to an image forming apparatus such as a printer or a storage device such as a computer connected to a network. Important specifications of such an image reading apparatus include a high capacity of reading a large number of documents at a high speed, and a short FCOT (First Copy Output Time), i.e., a capability of outputting a first copy in a short time after a copy start command is issued. Accordingly, there is a need for an increase in the maximum number of documents to be set at a time on a document tray of a document feeding apparatus. Thus, there is a need for an automatic document feeding apparatus having a document tray configured to be movable up and down by a lifter mechanism whereby documents can be properly handled regardless of whether a large or small number of sheets of documents are set on the document tray.

U.S. Pat. No. 6,091,927 discloses an automatic document feeding apparatus having a document tray with a lifter mechanism configured to be selectably operable in a first or second mode. In the first mode, the document tray is automatically raised in response to detecting setting of a document on the document tray. In the second mode, the document tray is raised in response to receiving a paper feed start signal.

Japanese Patent Laid-Open No. 09-166831 discloses an automatic document feeding apparatus having a document tray with a lifter mechanism configured to operate such that when feeding of documents is to be performed, the document tray is first raised and then feeding of documents is started. If a final document on the document tray has been fed, the document tray is lowered.

However, in the first mode disclosed in U.S. Pat. No. 6,091,927, the document tray is automatically raised immediately in response to detecting setting of documents on the document tray. In a case where a document stack including a large number of documents is set on the document tray by putting the document stack part by part, the document tray starts to rise in the middle of the operation of putting some part of the document stack. A user has to put remaining parts of documents on the document tray while the document tray is rising, and thus there is a possibility that the document tray reaches a paper feed position before all documents are set on the document tray. That is, there is a possibility that the user cannot set all documents on the document tray. If documents are set forcibly on the rising document tray, the documents are set in a space that is decreasing with rising of the document tray, and thus there is a possibility that the documents are not set properly. This leads to a possibility that documents are folded or a document feed error such as jamming can occur after feeding of documents is started.

In the second mode in U.S. Pat. No. 6,091,927 and also in the technique disclosed in Japanese Patent Laid-Open No. 09-166831, the document tray is raised to a paper feed position in response to inputting of a start command, and documents are sequentially moved to a document feed path. In this case there is substantially no possibility that a user sets documents incorrectly on the document tray. However, in a case where a small number of documents are set on the document tray, the document tray has to be raised a large distance until it reaches the paper feed position. The result of this is an increase in time spent before it becomes ready to start feeding documents.

In a technique disclosed in Japanese Patent Laid-Open No. 2004-166052, a document tray is raised when a start key or one of print condition setting keys disposed on an operation panel is pressed in a state in which documents are set on the document tray.

However, in the technique disclosed in Japanese Patent Laid-Open No. 2004-166052, if a user touches by mistake one of print condition setting keys during an operation of setting a large number of documents on the document tray, the document tray is raised against the intention of the user. In particular, in the case of an operation panel of a touch panel type, touching lightly can be detected as inputting of a command, and thus there is a large probability that an erroneous operation occurs.

SUMMARY OF THE INVENTION

In view of the above, the present invention provides a document feeding apparatus that solves the problems described above.

More specifically, the present invention provides a document feeding apparatus having a document tray configured to be automatically raised with substantially no error.

According to an aspect of the present invention, a document feeding apparatus includes a document tray configured to receive a document placed thereon and move up and down, a driving unit configured to cause the document tray to move up and down between a waiting position in which to wait a document to be placed and a feeding position in which the document is able to be fed, a feeding unit configured to feed the document in a state in which the document tray is in the feeding position, a start key configured to be used to issue a command to start a process accompanied by a document feeding of the feeding unit, an operation key configured to be used to set a condition for the process, a selection unit configured to select either a first mode or a second mode, and a control unit configured to control the driving unit such that in the first mode, the document tray is raised in response to an operation of the start key, and in the second mode, the document tray is raised in response to an operation of the operation key.

Further features of the present invention will become apparent from the following description of exemplary embodiments with reference to the attached drawings.

DESCRIPTION OF THE EMBODIMENTS

First Embodiment

Embodiments of the present invention are described below with reference to the accompanying drawings.

Image Reading Apparatus and Automatic Document Feeding Apparatus

Figure 1:
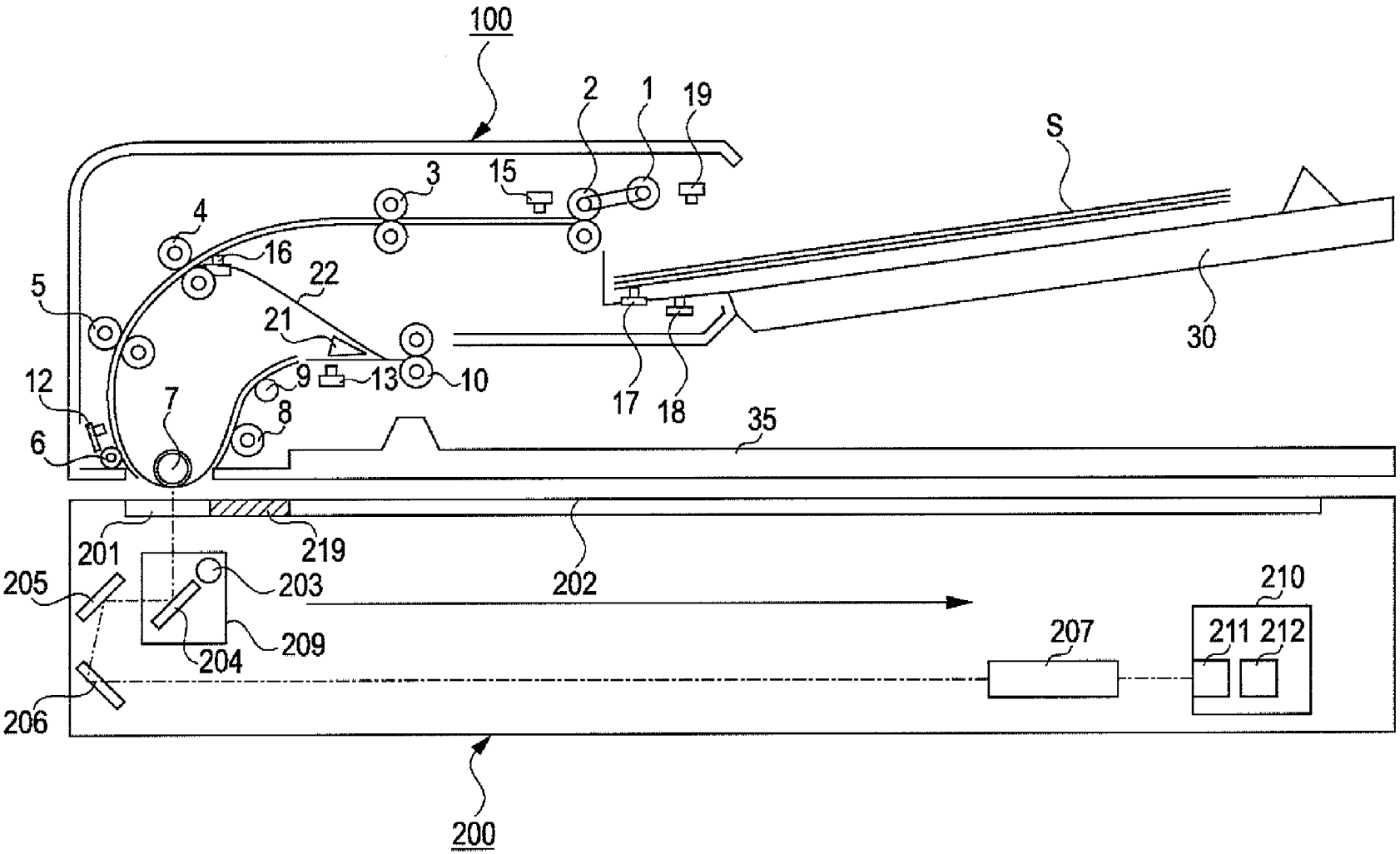
FIG. 1 is a cross-sectional view of an image reading apparatus and a document feeding apparatus according to an embodiment of the present invention.

FIG. 1 is a cross-sectional view of an automatic document feeding apparatus (ADF) 100 and an image reading apparatus 200 according to an embodiment of the present invention.

In FIG. 1, a document tray 30 is in a state in which it is lowered into its bottom position. The ADF 100 includes the document tray 30 configured to receive a document stack S including one or more documents placed thereon, a separation roller pair 2 for controlling advancing of a document of the document stack S in a forward direction into a feeding path from the document tray 30, and a paper feed roller 1. When paper feeding is not started yet or when no documents are set on the document tray 30, the document tray 30 is at rest in the bottom position that is a lowest allowable position in the up/down moving range. Note that simple setting of documents on the document tray 30 does not cause the document tray 30 to be raised. A document presence/absence detection sensor 17 detects whether there is a document on the document tray 30. A bottom detection sensor 18 detects whether the document tray 30 is in the bottom position.

Figure 4A:
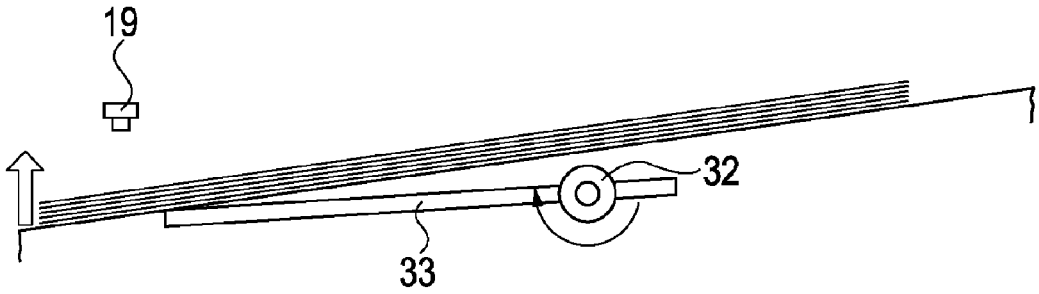
FIGS. 4A and 4B are diagrams illustrating a lifter mechanism of a document feeding apparatus.
Figure 4B:
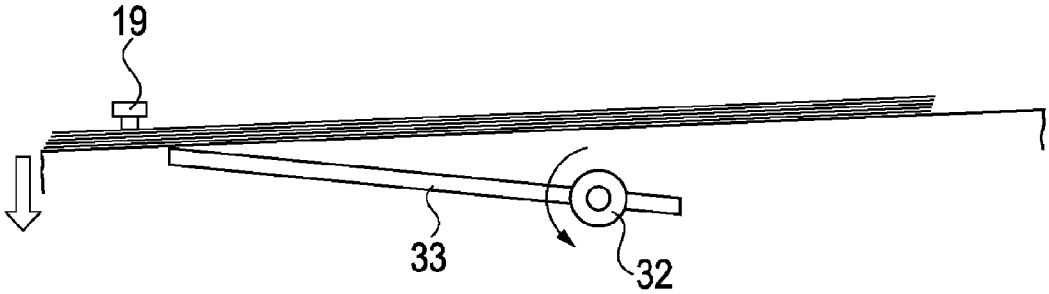

As shown in FIGS. 4A and 4B, the document tray 30 is supported at back by a lifter mechanism 31. The lifter mechanism 31 is configured to turn about a turning shaft 32 within a predetermined angle thereby raising or lowering a lifter plate 33. As shown in FIG. 4A, when the turning shaft 32 turns in a clockwise direction, the lifter plate 33 rises whereby the document tray 30 is raised by the lifter plate 33. On the other hand, as shown in FIG. 4B, when the turning shaft 32 turns in a counterclockwise direction, the lifter plate 33 moves down whereby the document tray 30 loses the support of the lifter plate 33 and the document tray 30 falls freely.

Figure 3:
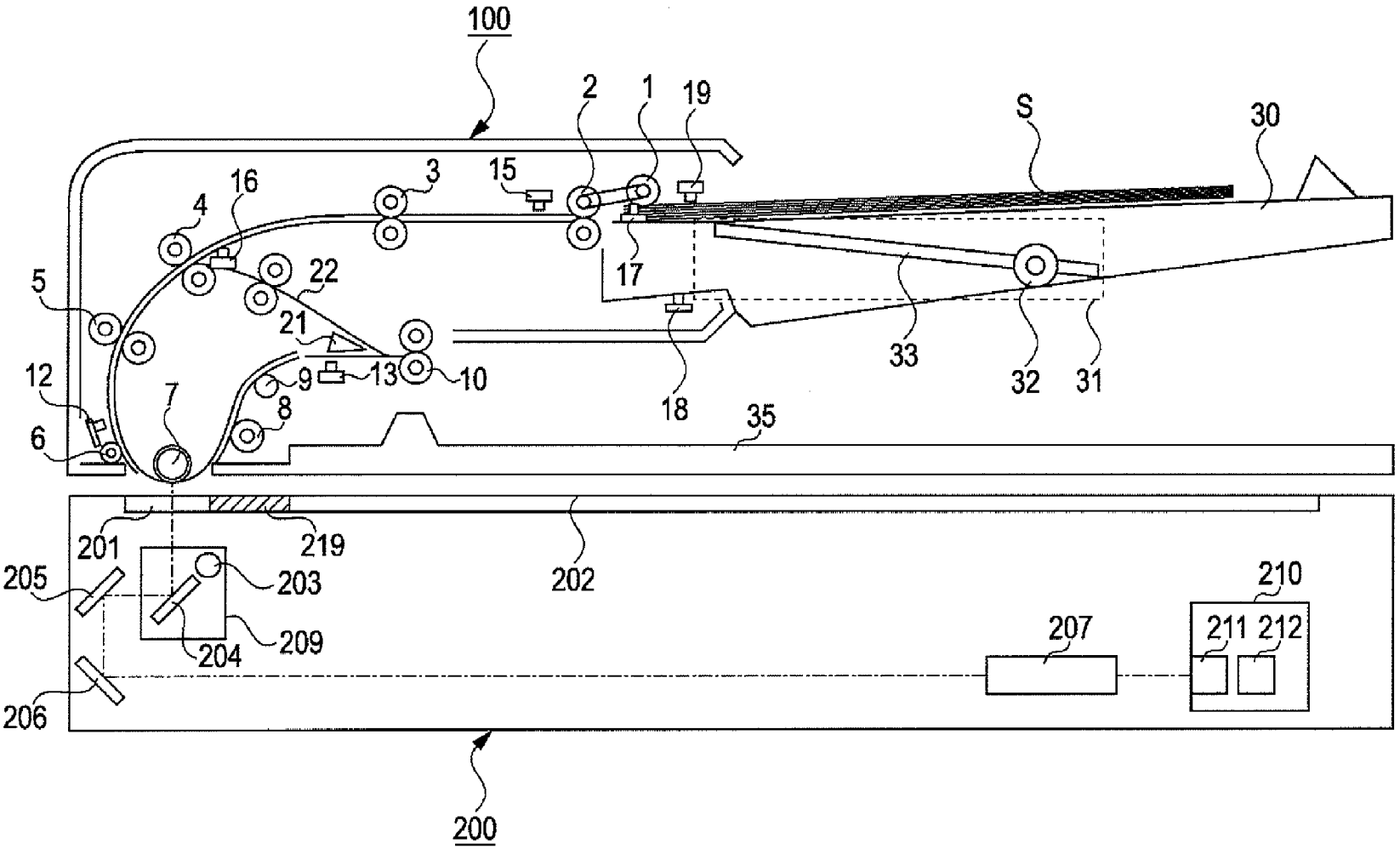
FIG. 3 is a cross-sectional view of an image reading apparatus and an automatic document feeding apparatus.

When the document tray 30 rises, if a document detection sensor 19 detects a document on the top of the document stack S set on the document tray 30, it is determined that the document tray 30 has been raised to a document feeding position in which documents can be fed (hereinafter simply referred to as the document feeding position), and driving of the lifter mechanism 31 is stopped. As a result, the raising operation of the document tray 30 is stopped. In FIG. 3, the document tray 30 is in the document feeding position after it has been raised to this position.

When the document tray 30 falls down, if the document tray bottom detection sensor 18 detects a back surface of the document tray, it is determined that the document tray 30 has fallen down to its bottom position, and driving of the lifter mechanism 31 is stopped. As a result, the document tray 30 stops falling down. This bottom position serves as a waiting position in which the document tray 30 waits for documents to be loaded.

If a document read start command is input, a scanner unit 209 of the image reading apparatus 200 moves to a position immediately below a standard white plate 219, and a shading correction is performed. After the shading correction is completed, the scanner unit 209 moves to a position immediately below moving-document read glass 201 and a document passing over a reading position is read.

Meanwhile, in response to inputting of the read start command, the document tray 30 is raised to the document feeding position, and the paper feed roller 1 serving as a feeding unit falls down on a document on the top of the document stack S loaded on the document tray 30 and starts to rotate to feed the document on the top of the document stack. When a plurality of documents are fed by the paper feed roller 1, the plurality of documents are separated by separation roller pair 2 such that only a single sheet of document is fed forward. The separation into a signal document may be accomplished by a known technique.

After the separation by the separation roller pair 2, the document is conveyed to a registration roller pair 4 by a conveying roller pair 3 When the document comes in contact with the registration roller 4, the document gets bent, and a skew at a leading end of the document is corrected.

A feeding roller pair 5 and a document reading roller 6 are disposed downstream from the registration roller pair 4. The document is further conveyed to the moving-document read glass 201 by the feeding roller pair 5, the document reading roller 6, and a document reading platen roller 7. When the document is conveyed to the glass 201, if the leading end of the document is detected by a lead sensor 12, then in response to the detection of the leading end of the document, a CPU 321 (described below) starts counting clocks of a driving source (not shown) of the document reading roller 6 and the document reading platen roller 7 to determine the location of the leading end of the document being conveyed. If it is detected that the leading end of the document has reached a reference position, the scanner unit 209 starts to read an image of the document. The document is fed forward by the document reading platen roller 7 and is further conveyed by a conveying roller 8 and a conveying roller 9. If a paper output sensor 13 detects a trailing end of the document, the detection of the trailing end of the document triggers the document to be further conveyed to a discharge roller pair 10. In the case of single-sided reading, the document is directly output to the document output tray 35.

If a sensor 15 detects the trailing end of the document, a determination is made using the document presence/absence detection sensor 17 as to whether there is a next document on the document tray 30. In a case where the document presence/absence detection sensor 17 indicates that there is no document on the document tray 30, the document tray 30 is moved down.

In a duplex reading mode, the discharge roller pair 10 is rotated in a reverse direction in a state in which the document is nipped between the discharge roller pair 10, and the position of a discharge flapper 21 is switched so that the document is moved into a reverse path 22. In the reverse path 22, the document is brought into contact with the registration roller pair 4 such that the document gets bent thereby correcting a screw at the leading end of the document. Thereafter, the document is again conveyed to the glass 201 by the feeding roller pair 5 and the platen roller 7, and the back side of the document is read.

A guide regulation plate (not shown) is disposed on the document tray 30 such that the guide regulation plate is slidable in a width direction of the document stack S loaded on the document tray 30. A document width detection sensor (not shown) is also disposed on the document tray 30 such that the document width detection sensor moves in accordance with the position of the guide regulation plate to detect a document width. A document length is determined by detecting the leading end of the document using the document width detection sensor and the sensor 16 and by detecting the trailing end of the document using the sensor 15. A document size is then determined based on a combination of the detected document length and the result of the detection performed by the document width detection sensor.

In the image reading apparatus 200, when a document manually placed on the document platen glass 202 is read, the optical scanner unit 209 moves in a sub scanning direction denoted by an arrow in FIG. 1 and reads an image of the document placed on the document platen glass 202. On the other hand, when reading is performed for a document being moved, the optical scanner unit 209 is moved to a reading center position of the document reading platen roller 7 of the ADF 100, and the reading is performed while the document is being conveyed over the reading center position of the document reading platen roller 7. The document is read by a combination of the glass 201, the document platen glass 202, a scanner unit 209 including a lamp 203 and a mirror 204, and an optical system including a mirrors 205 and 206, a lens 207, and a CCD sensor unit 210. Image information of the document obtained via the reading is converted into electric information and transferred as image data to a controller unit (not shown).

The standard white plate 219 is a white plate used in producing reference data of a white level by shading. Note that the CCD sensor unit 210 includes a three-line sensor unit 212 for reading color (RGB) images and a line sensor unit 211 for reading monochrome images.

Configurations of ADF and Image Reading Apparatus

Figure 2:
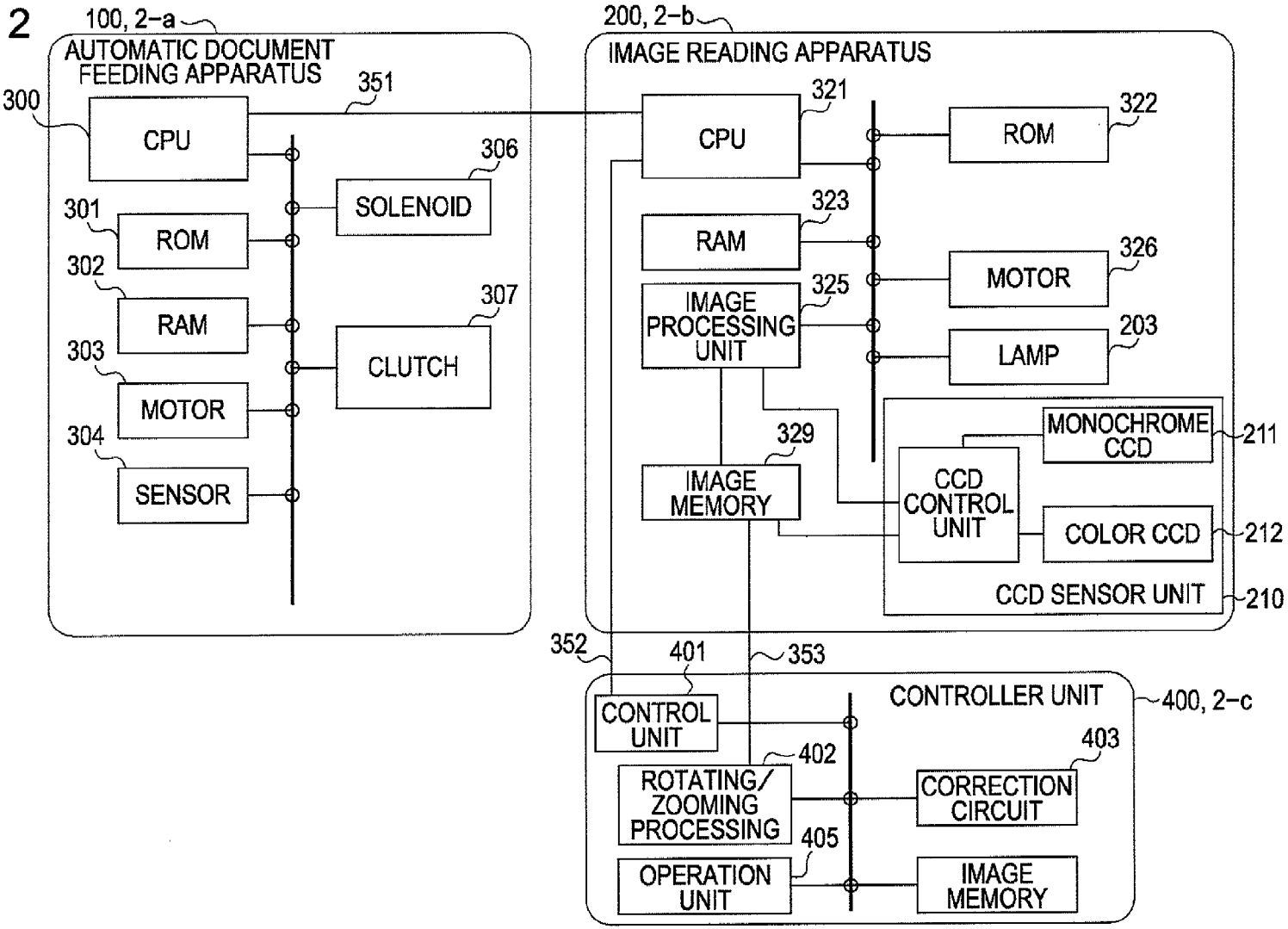
FIG. 2 is a block diagram illustrating configurations of a document feeding apparatus and an image reading apparatus.

FIG. 2 is a block diagram illustrating configurations of the ADF 100 and the image reading apparatus 200.

A circuit block 2-*a* is a control block of the ADF 100 and includes a CPU 300 serving as a control unit, a read-only memory (ROM) 301, a random access memory (RAM) 302, an output port, and an input port. A control program is stored in the ROM 301. The RAM 302 is used to store input data and/or work data. The output port is connected to the motors 303 that drive the various conveying rollers, the solenoids 306, and clutches 307. The input port is connected to the respective sensors 304. Note that in FIG. 2, the sensor 304 generically denotes all sensors shown in FIG. 1 and FIG. 3, i.e., the sensor 12, the paper output sensor 13, the sensor 15, the document presence/absence detection sensor 17, etc. Similarly, in FIG. 2, the motor 303 generically denotes all motors shown in FIGS. 1 and 3 such as the driving source motor, and the solenoid 306 and the clutch 307 generically denotes all solenoids and clutches.

The CPU 300 controls the conveying of documents in accordance with the control program stored in the ROM 301 connected to the CPU 300 via a bus line. The CPU 300 performs serial communication with central processing unit (CPU) 321 of the image reading apparatus 200 via a control communication line 351 to transmit/receive control data to/from the image reading apparatus 200. The control communication line 351 is also used to transmit an image start signal serving as a reference signal indicating the leading end of document image data to the image reading apparatus 200.

Circuit block 2-*b* is a control block of the image reading apparatus 200. A CPU 321 generally controls the image reading apparatus 200. The CPU 321 is connected to a ROM 322 in which a program is stored and a RAM 323 used as a work area. An optical system motor driver unit 326 drives a motor for moving the optical system. The image reading apparatus 200 is connected to a lamp 327, and the CCD sensor unit 210. The CPU 321 performs the image reading process by controlling the optical system motor driver unit 326 and controlling the CCD sensor unit 210 via an image processing unit 325.

To control the document conveying operation, the CPU 321 sends a document convey command to the CPU 300 via the control communication line 351. In accordance with the command, the CPU 300 monitors the respective sensors 304 disposed in the conveying path and drives the conveying motor 303, the solenoid 306, and the clutch 307 to control the document conveying operation. As described above, the CPU 321 controls both the document conveying operation of the ADF 100 and the image reading operation of the image reading apparatus 200.

An image signal output from the CCD sensor unit 210 is converted into digital image data and subjected to various kinds of image processing such as a shading correction performed by the image processing unit 325. The resultant image data is stored in an image memory 329. The data stored in the image memory 329 is sequentially transmitted to a controller unit 400 via controller interface image communication lines 353 including an image transfer clock signal line.

A circuit block 2-*c* is an image processing controller unit 400. The controller unit 400 controls the entire image reading system including the image reading apparatus 200 and the automatic document feeding apparatus 100. The controller unit 400 includes a control unit 401, an image control circuit 402 configured to control image processing such as zooming, rotating, etc., and a correction circuit 403.

The controller unit 400 detects and analyzes key inputting performed on the operation unit 405 in terms of setting information associated with a job such as a copying job, a job start trigger, etc.

A single CPU may control the document feeding apparatus 100, the image reading apparatus 200, and the controller unit 400. For example, the CPU 321 of the image reading apparatus 200 may control the document feeding apparatus 100, the operation unit 405, and other parts.

Figure 5:
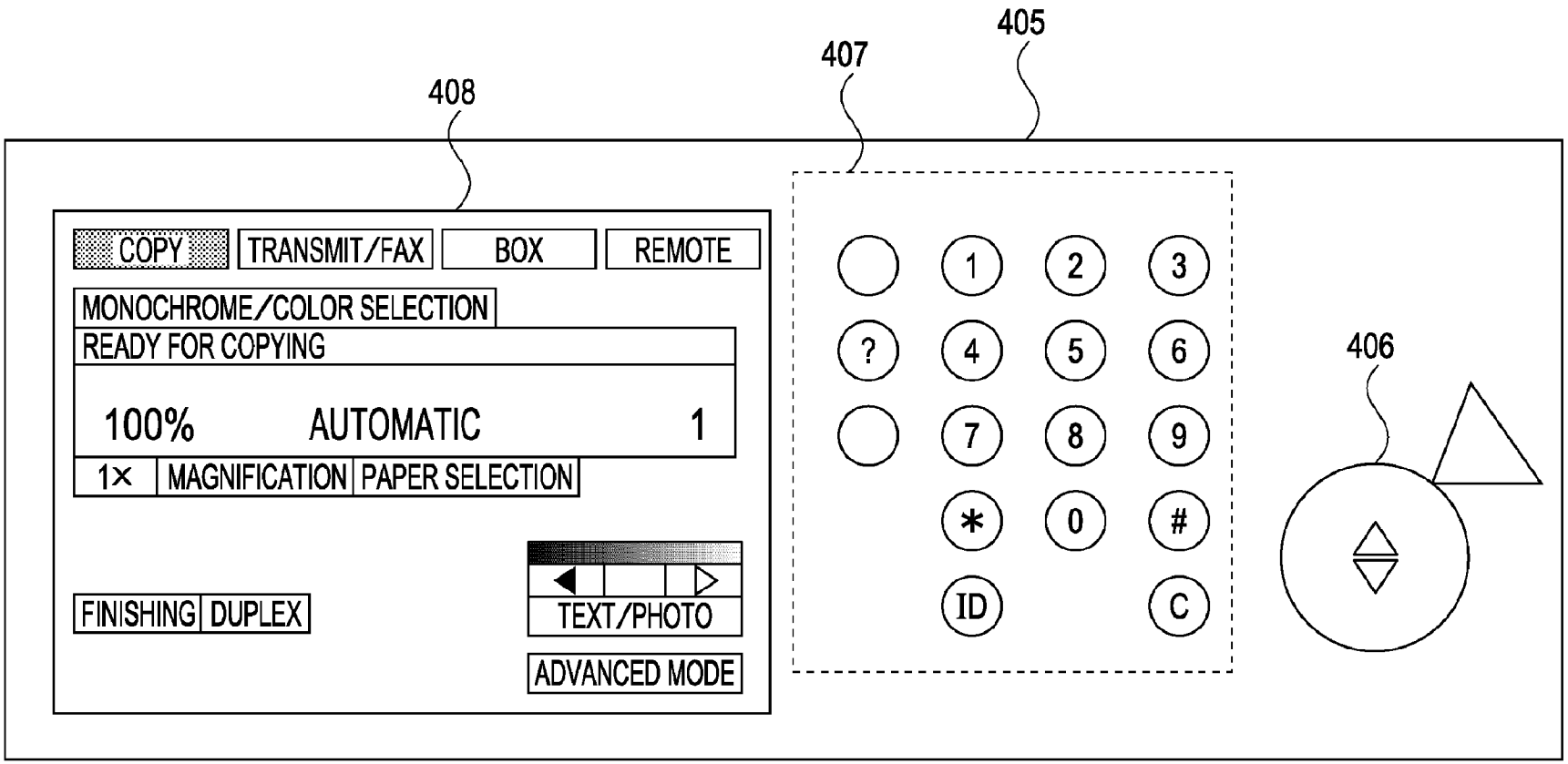
FIG. 5 is a diagram illustrating an operation unit.

FIG. 5 is a diagram illustrating the operation unit 405. A start key 406 is used to input a copy job start command, a facsimile transmission start command, and an image read start command. A key pad including numerical keys is disposed in an area denoted by a dashed line 407. A touch panel display is disposed in an area denoted by a dashed line 408 for use in setting conditions of copying or image reading operations and for displaying various kinds of information.

Rising Time of Document Tray

In the present embodiment, the document tray 30 is configured to load up to 300 sheets of documents. To this end, the document tray 30 is configured to be movable up and down. The rising time of the lifter varies depending on the number of sheets included in the document stack S loaded on the document tray 30. For example, in a case where the document stack S includes about 300 sheets, the lifter rises only a small distance and it takes about 0.5 seconds for the lifter to rise. On the other hand, when the document stack S includes only one sheet, the lifter rises a greater distance and it takes about 2.5 seconds for the lifter to rise.

Raising Operation of Document Tray

The operation of raising the document tray 30 of the ADF 100 according to the present embodiment is described in further detail below.

Figure 6:
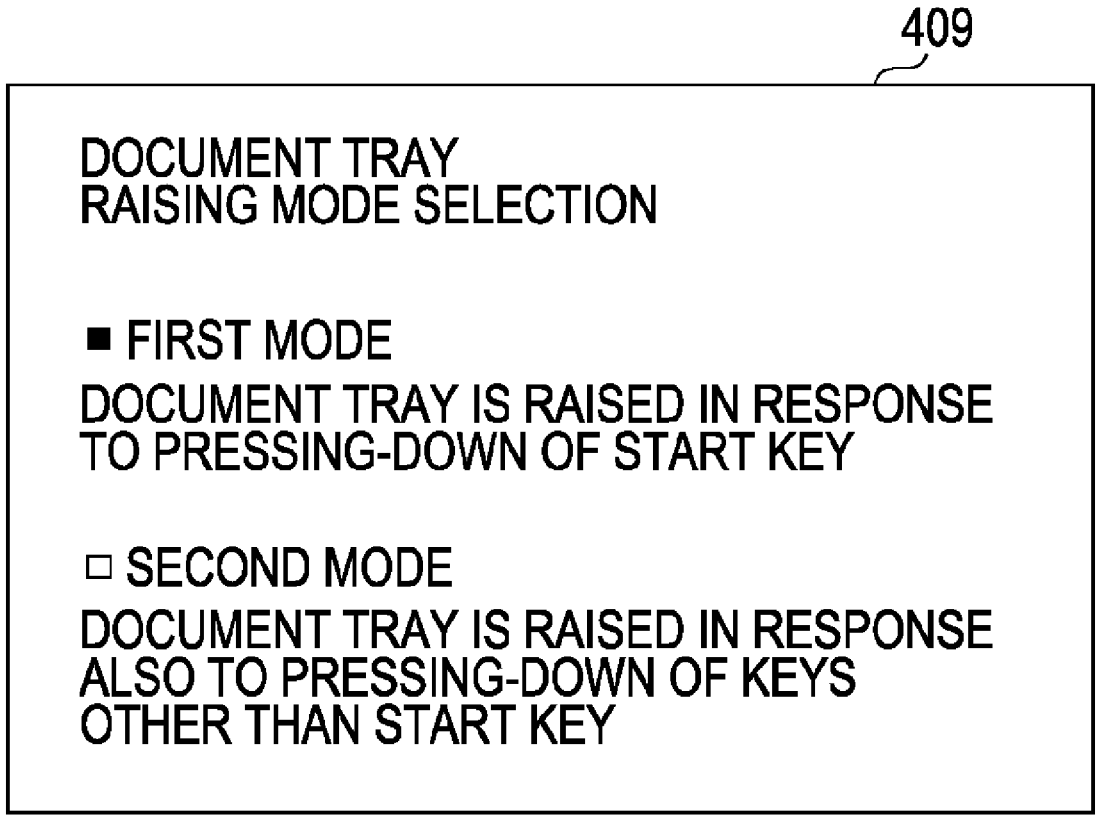
FIG. 6 is a diagram illustrating a setting screen for selecting a lifter raising mode.

A convenient way in which the document tray 30 is raised after documents are set by a user on the document tray 30 varies depending on an environment in which the document feeding apparatus is used by the user. In the present embodiment, in view of the above, the user is able to select a mode in which the document tray 30 rises. FIG. 6 illustrates an operation screen for selecting the mode in which the document tray 30 rises. This screen 409 is displayed on the touch panel display 408 shown in FIG. 5. On the screen 409, selection of either a first mode or a second mode is enabled. Either mode may be set as a default mode by a user in initial setting. The initial setting is stored in the RAM 323 that is backed by a battery such that data is maintained after the power of the image reading apparatus 200 is turned off. This enables the mode to be maintained after a job is completed unless the setting is changed. In the first mode, the document tray 30 starts rising when the start key 406 is pressed down (input) to start a job. In the second mode, the document tray 30 starts rising when one of the keys 407 or one of the keys on the touch panel display 408 even if the start key 406 has not been pressed down. That is, in the second mode, the document tray 30 starts to rise in response to pressing down any operation key. Note that in the second mode, the document tray 30 starts rising also when the start key 406 is pressed down.

In a state in which the first mode is selected, the document tray 30 does not move up unless the start key 406 is pressed down after documents are set on the document tray 30. That is, in the state in which the first mode is selected, the document tray 30 does not start moving up when any key other than the start key 406 is pressed down. In the first mode, operations of setting of documents on the document tray 30 and setting the mode of the image forming process or the image reading process may be performed in an arbitrary order, i.e., either operation may be performed first. This ensures that the document tray starts to rise after documents are set on the document tray 30.

In general, in a case where a key other than the start key 406 is pressed down by a user to set an image forming mode after documents are set on the document tray 30, an image forming job is most likely to be performed. Therefore, in a state in which the second mode is selected, the document tray 30 starts to rise when some key is pressed down to set the image forming mode after documents are set on the document tray 30. Thus, the document tray 30 starts to rise before the start key 406 is pressed down, which makes it possible to reduce a waiting time before feeding of a document is started even in the case where a small number of documents are placed on the document tray 30. Furthermore, as in the first mode, it is ensured that the document tray 30 starts to rise after documents are set on the document tray 30.

When the document stack S to be set on the document tray 30 includes a large number of sheets of documents, a user may set the total of document stack S by putting documents part by part on the document tray 30. However, if only the second mode is available and the first mode is not available, there is a possibility that the document tray starts to rise with unintended timing when some key on the operation unit is touched by mistake in the middle of the operation of setting documents on the document tray 30 part by part. In such a case, if the first mode is selected, it is possible to start raising the document tray 30 by pressing down the start key 406 after setting of all documents on the document tray 30 is completed. The selectivity of the mode between the first mode and the second mode depending on the preference of a user provides improved convenience to the user.

The CPU 300 of the ADF 100 shown in FIG. 2 controls the various sensors 304 and the various motors 303. The CPU 300 communicates with the CPU 321 of the reading apparatus 200 and sends control information indicating states of the sensors 304 and the motors 303 to the CPU 321 of the reading apparatus 200. Based on the control information associated with the sensors 304 and the motors 303 of the ADF 100 received from the ADF 100, the CPU 321 of the reading apparatus 200 sends a processing command to the CPU 300 of the ADF 100 as required. The ADF 100 performs an operation in accordance with the received command. For example, according to the processing command sent from the CPU 321 to the CPU 300, a feeding motor is driven to start the feeding operation or is stopped depending on the information associated with the sensor 15, or other operations are controlled.

The CPU 321 of the reading apparatus 200 is capable of detecting a key operation performed by a user by acquiring, via communication with the control unit 401 of the controller unit 400, input information from the operation unit 405 detected by the controller unit 400. Thus, via the communication with the control unit 401 of the controller unit 400, the CPU 321 of the reading apparatus 200 is capable of always acquiring the information input via the operation unit 405. The information includes information associated with the operation of the start key 406, and information associated with the operation of keys other than the start key 406. The CPU 321 of the reading apparatus 200 monitors the information input via the operation unit 405. In accordance with the input information, CPU 321 transmits a command to the ADF 100 or controls the reading apparatus 200.

Figure 11:
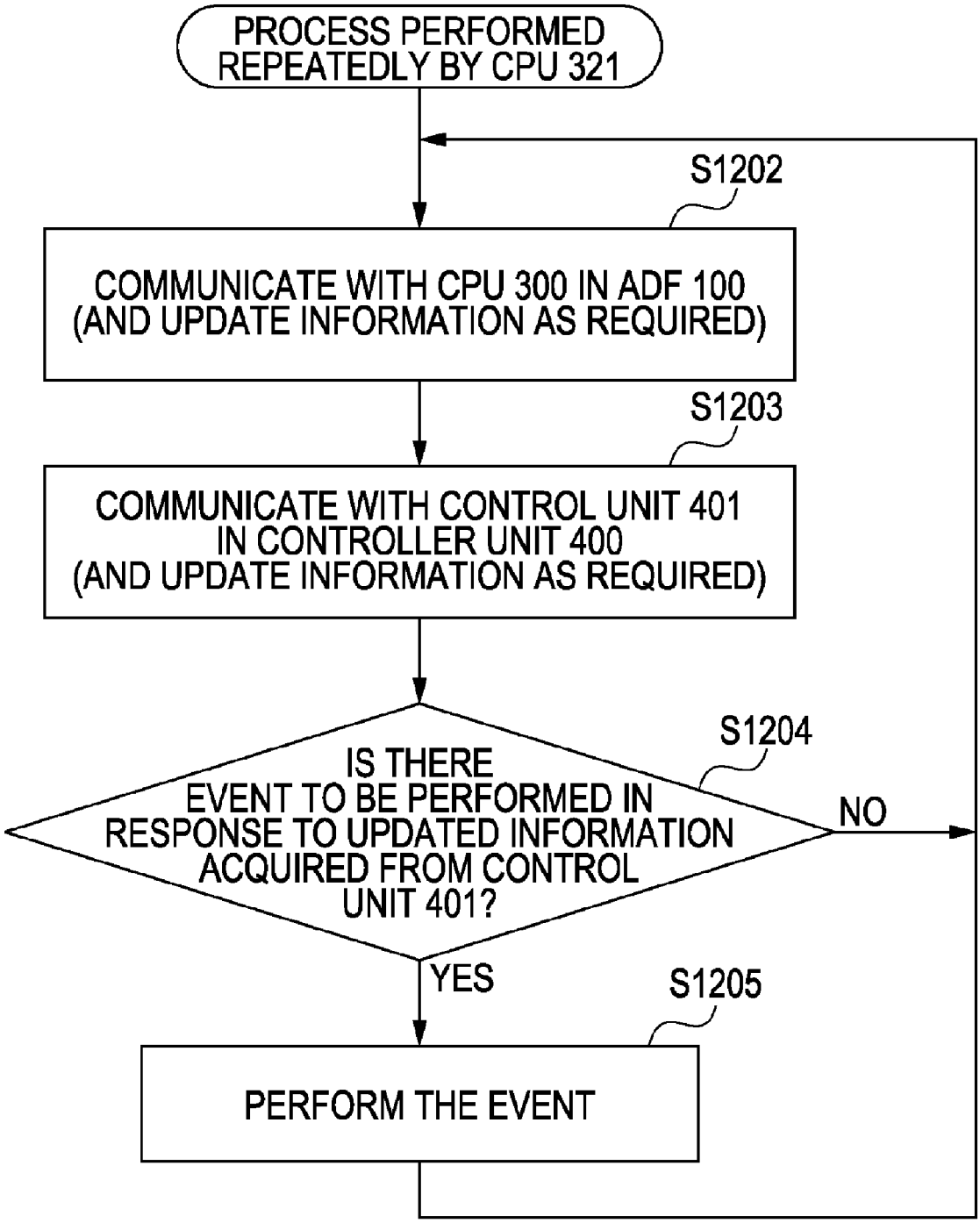
FIG. 11 is a flow chart illustrating a process performed repeatedly by a CPU of an image reading apparatus.

FIG. 11 is a flow chart illustrating a control process performed by the CPU 321 of the reading apparatus 200. The CPU 321 performs the process shown in FIG. 11 repeatedly regardless of whether or not there is a job as long as electric power of the apparatus is in the ON state. The CPU 321 continuously communicates with the CPU 300 of the ADF 100 to acquire control information associated with the ADF 100 and to send a control command to the CPU 300 of the ADF 100 as required (step S1202). The CPU 321 also continuously communicates with the control unit 401 of the controller unit 400 via a control signal line 352 to receive/send updated information from/to the controller unit 400 (step S1203). The CPU 321 checks whether there is an event to be performed in response to the updated information acquired via the communication with the control unit 401 (step S1204). For example, if a user presses down the start key 406 shown in FIG. 5 to start a job, the control unit 401 detects the key inputting operation and notifies the CPU 321 of the reading apparatus 200 that the start key 406 has been pressed down. On receiving the job start notification, the CPU 321 makes a preparation for an event to be performed in response to the job start notification, that is, the CPU 321 makes preparations for the job to be performed by the reading apparatus 200 and the ADF 100 including the document conveying operation (step S1205). If the event is completed, the processing flow returns to step S1202 to perform the communication with the CPU 300 of the ADF 100. If there is no event to be performed in response to the updated information acquired via the communication with the control unit 401, the processing flow returns to step S1202 to perform the communication with the CPU 300 of the ADF 100. The process from step S1202 to step S1205 is performed repeatedly as long as the power of the apparatus is in the ON state.

In a case where the event is to raise the document tray 30, the CPU 321 of the reading apparatus 200 sends a command to the CPU 300 of the ADF 100 to rotate the lifter motor serving as the driving source of the lifter mechanism 31 thereby raising the document tray 30. If the CPU 300 receives the command to rotate the lifter motor, the CPU 300 rotates the lifter motor that is one of the motors 303. When the document tray 30 is raised by the lifter motor, if the document detection sensor 19 detects a document on the top of the document stack S, the CPU 300 of the ADF 100 sends a command to the CPU 321 of the reading apparatus 200 to stop raising the document tray 30. In response, the CPU 321 of the reading apparatus 200 sends a command to the CPU 300 of the ADF 100 to stop the driving operation of the lifter motor of the lifter mechanism 31 of the ADF 100. In response to the command to stop the lifter motor, the CPU 300 stops the operation of the lifter motor. Alternatively, the CPU 300 may stop the driving operation of the lifter motor in accordance with information output of the document detection sensor 19.

When a selection is performed via the setting screen 409 shown in FIG. 6, the control unit 401 notifies the CPU 321 of the selection. The CPU 321 performs an event in response to the notified information. That is, the CPU 321 controls the document tray 30 to rise in the selected mode.

Figure 7:
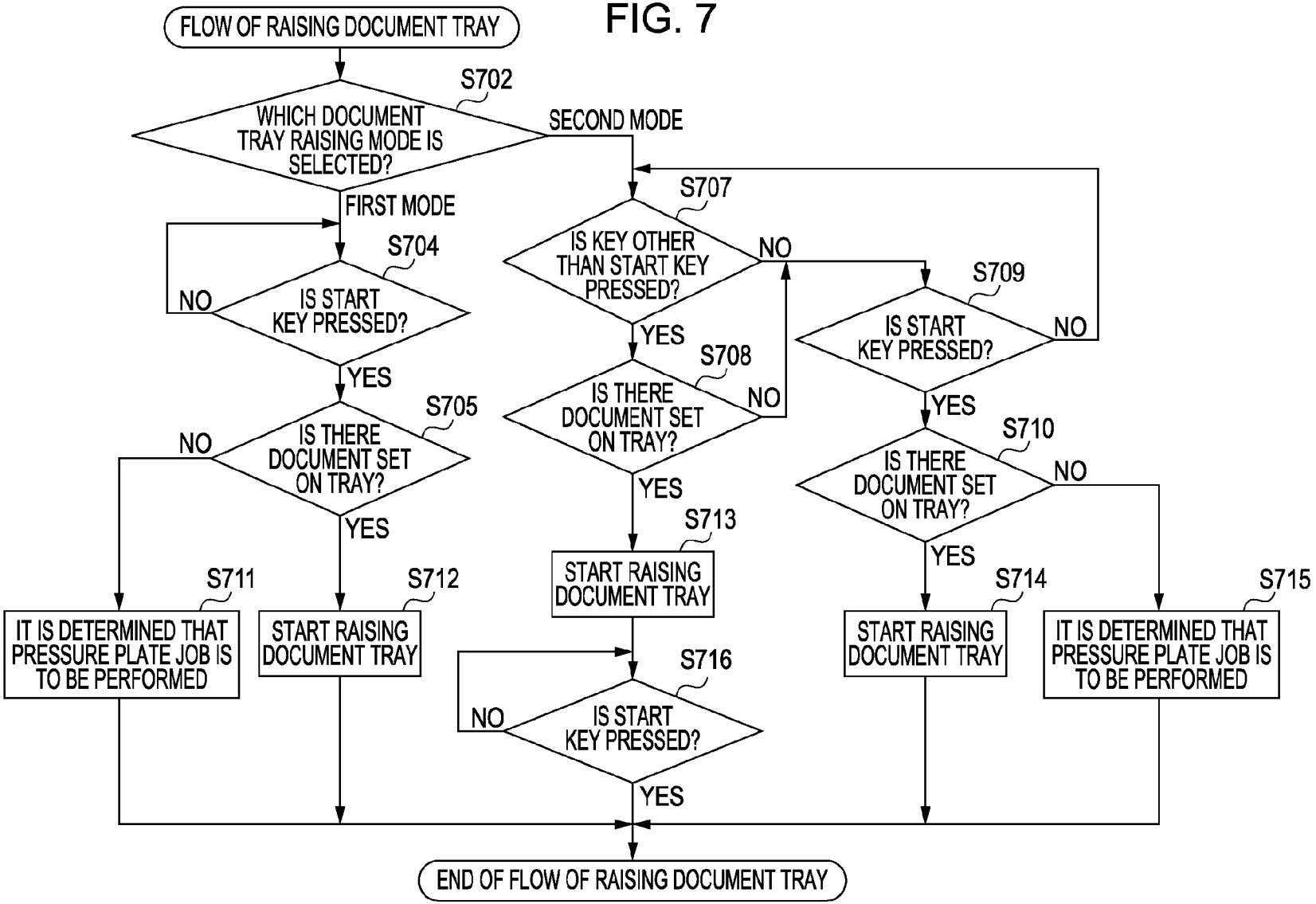
FIG. 7 is a flow chart illustrating a process of controlling the raising of a document tray according to an embodiment of the present invention.

The process of controlling the operation of raising the document tray 30 is described below with reference to a flow chart shown in FIG. 7. This process shown in FIG. 7 is executed by the CPU 321 of the reading apparatus 200.

The CPU 321 communicates with the control unit 401 and determines whether the raising mode of the document tray 30 is set in the first mode or the second mode (step S702). In a case where the first mode is selected, the CPU 321 determines whether the start key 406 is pressed down (step S704). If the start key 406 is pressed down, the CPU 321 makes a determination via the communication with the CPU 300 as to whether there is a document placed on the document tray 30 (step S705). If there is a document on the document tray 30, the CPU 321 determines that a job using the ADF 100 is to be performed, and the CPU 321 sends a command to the CPU 300 to raise the document tray 30 and feed the document (step S712). On the other hand, if there is no document on the document tray 30, the CPU 321 determines that reading of a document placed on the document platen glass 202 is to be performed as a job without using the ADF 100 (step S711). As described above, when the first mode is selected, the raising of the document tray 30 is started in response to pressing down the start key 406, and thus it is ensured that documents can be set properly on the document tray 30.

On the other hand, in a case where it is determined in step S702 that the second mode is selected, the CPU 321 makes a determination via the communication with the control unit 401 as to whether a key other than the start key 406 is pressed down (step S707). If a key other than the start key 406 is pressed, then the CPU 321 makes a determination via the communication with the CPU 300 as to whether there is a document placed on the document tray 30 (step S708). If there is a document on the document tray 30, the CPU 321 determines that a job using the ADF 100 is to be performed, and the CPU 321 sends a command to the CPU 300 to raise the document tray 30 (step S713), and the CPU 321 waits for the start key 406 to be pressed. If the start key 406 is pressed (step S716), the CPU 321 sends a command to the CPU 300 to feed the document. On the other hand, in a case where the determination in step S707 is negative as to whether a key other than the start key 406 is pressed, the CPU 321 makes a determination via the communication with the control unit 401 as to whether the start key 406 is pressed down (step S709). Note that in a case where it is determined in step S708 that there is no document on the document tray 30, the processing flow also proceeds to step S709. If it is determined that the start key 406 is not pressed, the process returns to step S707. In the case where it is determined that the start key 406 is pressed, the CPU 321 makes a determination via the communication with the CPU 300 as to whether there is a document placed on the document tray 30 (step S710). If there is a document on the document tray 30, the CPU 321 determines that a job using the ADF 100 is to be performed, and the CPU 321 sends a command to the CPU 300 to raise the document tray 30 and feed the document (step S714). On the other hand, if there is no document on the document tray 30, the CPU 321 determines that reading of a document placed on the document platen glass 202 is to be performed as a job without using the ADF 100 (step S715). In the second mode, as described above, after documents are set on the document tray, the mode in terms of forming or reading an image is set by operating a key on the operation unit 405, and, in response to the operation of the key on the operation unit 405, raising of the document tray 30 is started. This leads to a reduction in the time spent before feeding of the document is started. That is, when the start key 406 is pressed, the rising of the document tray 30 is completed or almost completed. Thus, the waiting time for the completion of the rising of the document tray 30 can be reduced even in the case where the document stack S includes a small number of sheets of documents.

Second Embodiment

Figure 8:
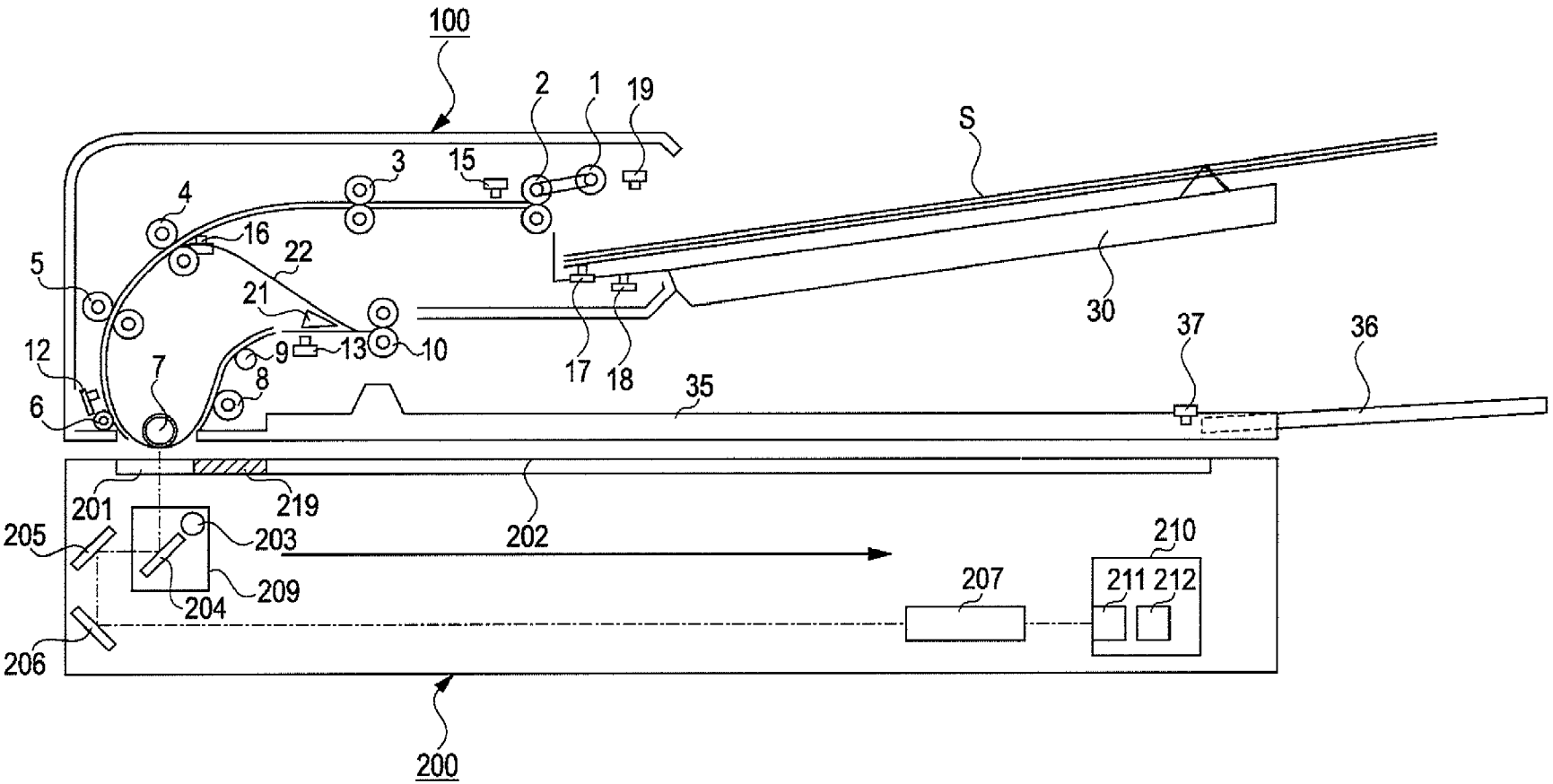
FIG. 8 is a cross-sectional view of an image reading apparatus and a document feeding apparatus according to an embodiment of the present invention.

Depending on documents treated by the ADF 100, the length of the documents as measured in the conveying direction may be longer than a normal length. Such a situation can occur, for example, for A3-size documents. In such a case, as shown in FIG. 8, a user may drawn a paper output sub-tray 36 from the paper output tray 35 such that documents output onto the paper output tray 35 after completion of reading are supported by the paper output sub-tray 36 thereby preventing the documents from falling down from the paper output tray 35. In view of the above, before a job is started, a determination as to whether the paper output sub-tray 36 serving as an operation member is drawn is made using a paper output sub-tray sensor 37 disposed close to the paper output sub-tray 36. If drawing of the paper output sub-tray 36 is detected in a state in which there is a document placed on the document tray 30, then, in response to the detection, raising of the document tray 30 is started. This makes it possible, as in the first embodiment, to start the raising of the document tray 30 before the start key 406 is pressed down.

Figure 9:
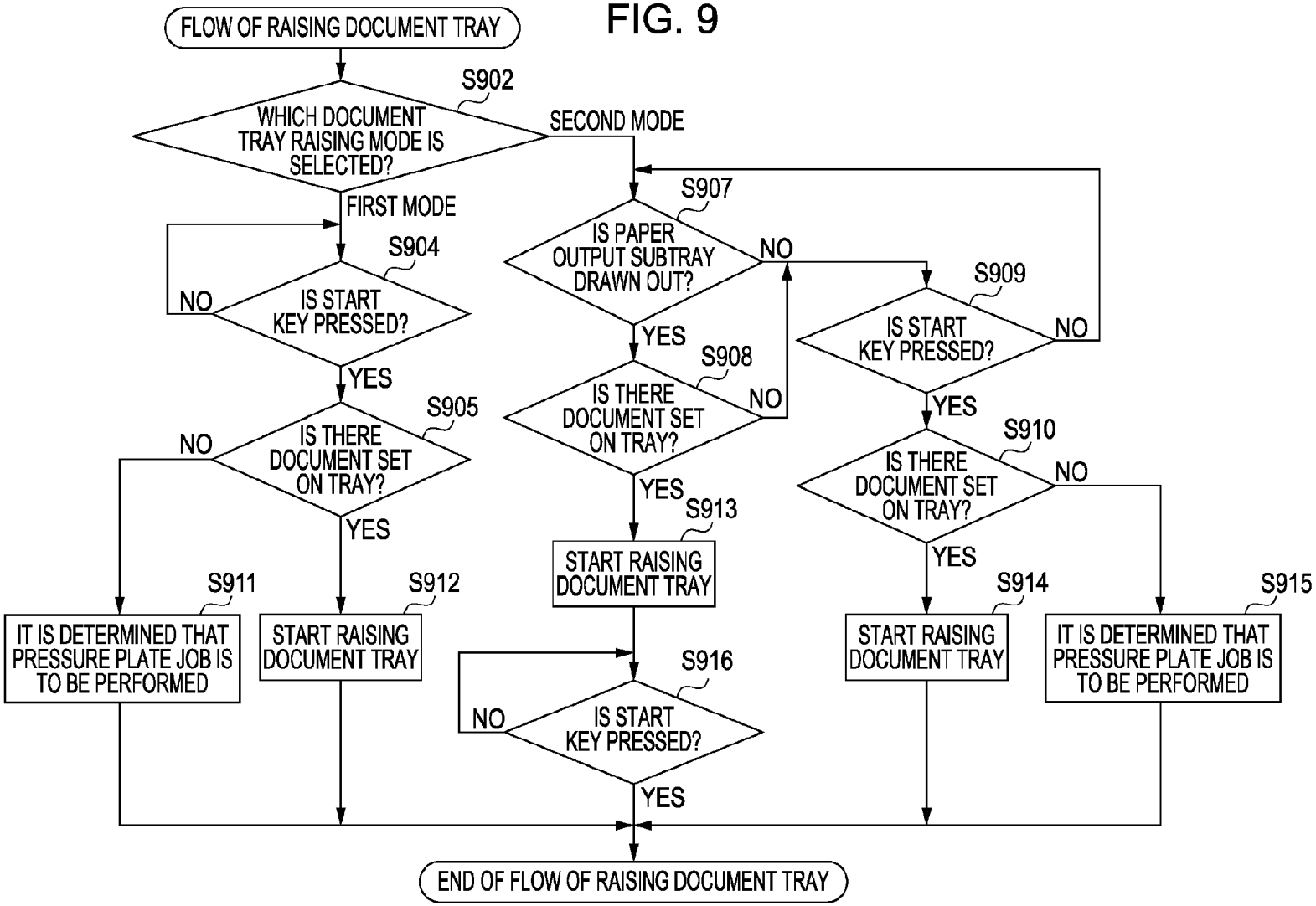
FIG. 9 is a flow chart illustrating a process of controlling the raising of a document tray according to an embodiment of the present invention.

The process of controlling the operation of raising the document tray 30 according to the second embodiment is described below with reference to a flow chart shown in FIG. 9.

In a case where the first mode is selected in step S902, processes in steps S904, S905, S911 and S912 are performed in a similar manner to steps S704, S705, S711, and S712 shown in FIG. 7. In a case where the second mode is selected, the CPU 321 makes a determination via the communication with the CPU 300 as to whether the paper output sub-tray 36 is drawn (step S907). In the second mode according to the second embodiment, the drawing of the paper output sub-tray 36 also causes the document tray 30 to start to rise. Note that, in the second mode according to the second embodiment, as in the first embodiment, the document tray also starts to rise in response to pressing down the start key 406. If the CPU 300 detects that the paper output sub-tray sensor 37 turns off, the CPU 300 determines that the paper output sub-tray 36 has been drawn and notifies the CPU 321 of this fact. Step S908, step S909, step S910, step S913, step S914, step S915 and step S916 are similar to step S708, step S709, step S710, step S713, step S714, step S715 and step S716 in FIG. 7.

As described above, when the second mode is selected, if it is detected that the paper output sub-tray 36 is drawn before the start key 406 is pressed down, the document tray 30 is raised to a height that enables a document to be fed into the document conveying path. This provides for a reduction in time spent before feeding of the document is started.

A document sub-tray for supporting a long-sized document such as an A3-size document may be disposed such that the document sub-tray can be drawn from the document tray 30. If the document sub-tray is drawn in a state in which there is a document on the document tray 30, then, in response to the drawing of the document sub-tray, the raising of the document tray 30 may be started. In this case, the document sub-tray serves to support documents at their trailing end as seen in the document conveying direction.

Other Embodiments

Figure 10A:
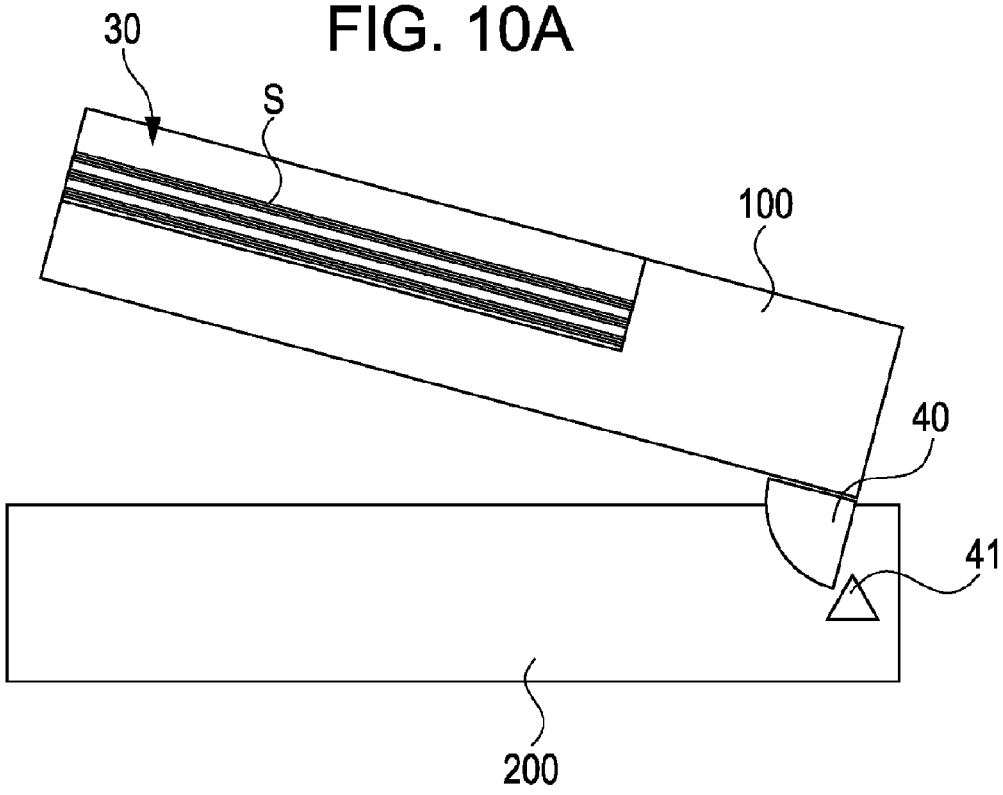
FIG. 10A is a diagram illustrating a document feeding apparatus in an open state.
Figure 10B:
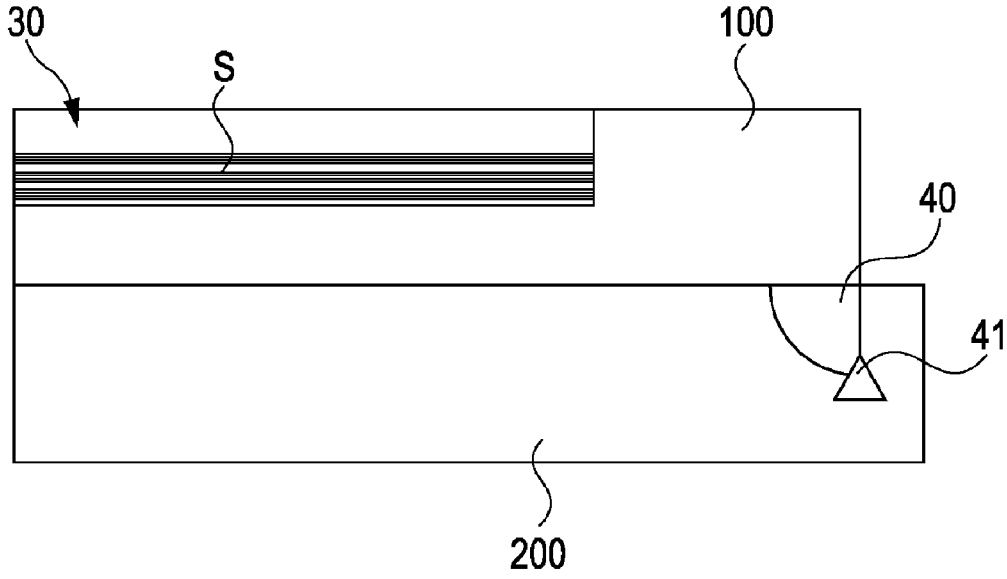
FIG. 10B is a diagram illustrating the document feeding apparatus in a closed state.

There is a possibility that after documents are set on the document tray 30, a user opens the ADF 100 to confirm that there is no document remaining on the document plate after an immediately previous job performed without using the ADF 100. FIG. 10A illustrates the ADF 100 in an open state, and FIG. 10B illustrates the ADF 100 in a closed state. When the ADF 100 is in the closed state, the ADF open/close detection sensor 41 detects an ADF open/close detection flag 40. However, when the ADF 100 is in the open state, ADF open/close detection sensor 41 does not detect the ADF open/close detection flag 40. Therefore, raising of the document tray 30 may be started when closing of the ADF 100 is detected after the ADF 100 is opened in the second mode and a document is detected on the document tray 30 at the point of time when the ADF 100 is closed.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-321630 filed Dec. 17, 2008, which is hereby incorporated by reference herein in its entirety.

What is claimed is:

1. A document feeding apparatus comprising:

a document tray configured to receive a document placed thereon and to move up and down;

a driving unit configured to cause the document tray to move up and down between a waiting position in which to wait for the document to be placed and a feeding position in which the document is able to be fed;

a feeding unit configured to feed the document in a state in which the document tray is in the feeding position;

a sensor configured to detect whether there is the document placed on the document tray;

a start key configured to be used to issue a command to start a process accompanied by a document feeding of the feeding unit;

an operation key configured to be used to set a condition for the process;

a selection unit configured to select either a first mode or a second mode; and a control unit configured to control the driving unit such that in the first mode, the document tray is raised in response to an operation of the start key but the document tray does not respond to the operation key when the sensor detects that there is the document placed on the document tray, and in the second mode, the document tray is raised in response to an operation of either the operation key or the start key when the sensor detects that there is the document placed on the document tray.

2. The document feeding apparatus according to claim 1, wherein the process includes reading an image of the document.

3. The document feeding apparatus according to claim 1, wherein the waiting position is at a position lower than that of the feeding position.

4. The document feeding apparatus according to claim 1, wherein after the first or second mode has been selected, the mode that has been selected is maintained after the process finishes.

5. A document feeding apparatus comprising:

a document tray configured to receive a document placed thereon and to move up and down;

a driving unit configured to cause the document tray to move up and down between a waiting position in which to wait for the document to be placed and a feeding position in which the document is able to be fed;

a feeding unit configured to feed the document in a state in which the document tray is in the feeding position;

a sensor configured to detect whether there is the document placed on the document tray;

a start key configured to be used to issue a command to start a process accompanied by a document feeding of the feeding unit;

a movable operation member configured to be operated to prepare for the process;

a selection unit configured to select either a first mode or a second mode; and a control unit configured to control the driving unit such that in the first mode, the document tray is raised in response to an operation of the start key but the document tray does not respond to the operation member when the sensor detects that there is the document placed on the document tray, and in the second mode, the document tray is raised in response to an operation of either the operation member or the start key when the sensor detects that there is the document placed on the document tray.

6. The document feeding apparatus according to claim 5, wherein the movable operation member is a movable discharge tray onto which the document fed by the feeding unit is discharged.

* * * * *